US009526324B2

(12) United States Patent
Lee

(10) Patent No.: US 9,526,324 B2
(45) Date of Patent: Dec. 27, 2016

(54) ORAL CARE IMPLEMENT

(75) Inventor: David Lee, East Brunswick, NJ (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 783 days.

(21) Appl. No.: 13/876,990

(22) PCT Filed: Sep. 30, 2010

(86) PCT No.: PCT/US2010/050961

§ 371 (c)(1),
(2), (4) Date: Jun. 12, 2013

(87) PCT Pub. No.: WO2012/044312

PCT Pub. Date: Apr. 5, 2012

(65) Prior Publication Data

US 2013/0255017 A1 Oct. 3, 2013

(51) Int. Cl.

| | |
|---|---|
| ***A46B 3/22*** | (2006.01) |
| ***A46B 9/04*** | (2006.01) |
| ***A46B 9/06*** | (2006.01) |
| ***A46B 15/00*** | (2006.01) |
| ***A46B 9/02*** | (2006.01) |
| ***A46B 9/00*** | (2006.01) |

(52) U.S. Cl.

CPC . *A46B 9/04* (2013.01); *A46B 3/22* (2013.01); *A46B 9/005* (2013.01); *A46B 9/028* (2013.01); *A46B 9/06* (2013.01); *A46B 15/0081* (2013.01)

(58) Field of Classification Search

CPC ..... A46B 9/04; A46B 9/06; A46B 3/22; A46B 9/005; A46B 9/028; A46B 15/0081

See application file for complete search history.

(56) References Cited

U.S. PATENT DOCUMENTS 1,691,863 A * 11/1928 Van Sant ..... A46B 9/005 15/110
3,129,449 A 4/1964 Cyzer
3,707,042 A 12/1972 Talaga
(Continued)

FOREIGN PATENT DOCUMENTS

EP 2158820 A1 3/2010
EP 2158872 A1 3/2010

OTHER PUBLICATIONS

International Search Report and the Written Opinion issued in International Application PCT/US2010/050961 mailed Jul. 4, 2011.
(Continued)

*Primary Examiner* — Randall Chin

(57) ABSTRACT

An oral care implement such as a toothbrush includes a head and a plurality of tooth cleaning elements supported by the toothbrush head. The tooth cleaning elements preferably include an elastomeric scrubbing element having a base portion and a tooth engaging portion comprising a plurality of cleansing members circumferentially spaced apart on the base portion. In one embodiment, the base portion has a circumferentially continuous sidewall to stiffen the scrubbing element. The cleansing members project outwards and preferably upwards from the base portion in one embodiment to collectively define a central cavity for retaining dentifrice. Embodiments of the oral care implement may include a circular bristle field arranged circumferentially around and associated with the scrubbing element.

21 Claims, 6 Drawing Sheets

(56) References Cited

U.S. PATENT DOCUMENTS

| | | | | |
|---|---|---|---|---|
| 4,348,060 | A | 9/1982 | Lewis, Jr. | |
| 5,511,275 | A | 4/1996 | Volpenhein et al. | |
| 5,604,951 | A * | 2/1997 | Shipp | A46B 9/06 15/110 |
| 5,628,082 | A | 5/1997 | Moskovich | |
| 5,735,011 | A | 4/1998 | Asher | |
| 5,802,656 | A | 9/1998 | Dawson et al. | |
| 5,970,564 | A | 10/1999 | Inns et al. | |
| 6,016,587 | A | 1/2000 | Savitt et al. | |
| 6,108,851 | A | 8/2000 | Bredall et al. | |
| D469,958 | S | 2/2003 | Saindon et al. | |
| 6,527,552 | B2 | 3/2003 | Loddeke et al. | |
| D480,562 | S | 10/2003 | Saindon et al. | |
| 6,641,764 | B2 | 11/2003 | Lanvers | |
| 6,988,777 | B2 | 1/2006 | Pfenniger et al. | |
| 7,213,288 | B2 | 5/2007 | Hohlbein | |
| 7,322,067 | B2 | 1/2008 | Hohlbein | |
| 7,389,557 | B2 | 6/2008 | McDougall | |
| 7,614,111 | B2 | 11/2009 | Moskovich et al. | |
| D611,711 | S | 3/2010 | Driesen et al. | |
| D612,611 | S | 3/2010 | Brown, Jr. et al. | |
| 7,703,163 | B2 | 4/2010 | Jimenez et al. | |
| 7,707,677 | B2 | 5/2010 | Moskovich et al. | |
| 7,721,376 | B2 | 5/2010 | Hohlbein et al. | |
| RE45,141 | E * | 9/2014 | Fischer | 15/110 |
| 2001/0023516 | A1 | 9/2001 | Driesen et al. | |
| 2002/0108194 | A1 | 8/2002 | Carlucci et al. | |
| 2002/0138926 | A1 | 10/2002 | Brown, Jr. et al. | |
| 2002/0138928 | A1 | 10/2002 | Calabrese | |
| 2003/0033680 | A1 | 2/2003 | Davies et al. | |
| 2003/0084528 | A1 | 5/2003 | Chan et al. | |
| 2003/0159224 | A1 | 8/2003 | Fischer et al. | |
| 2003/0182744 | A1 | 10/2003 | Fattori et al. | |
| 2004/0123409 | A1 | 7/2004 | Dickie | |
| 2004/0200016 | A1 | 10/2004 | Chan et al. | |
| 2005/0166343 | A1 | 8/2005 | Gavney, Jr. | |
| 2009/0007357 | A1 | 1/2009 | Meadows et al. | |
| 2009/0106923 | A1 | 4/2009 | DePuydt et al. | |
| 2009/0282628 | A1 | 11/2009 | Braun et al. | |
| 2010/0024144 | A1 | 2/2010 | Moskovich et al. | |
| 2010/0043162 | A1 | 2/2010 | Zimmermann et al. | |
| 2010/0050356 | A1 | 3/2010 | Baertschi et al. | |

OTHER PUBLICATIONS

Written Opinion of the International Preliminary Examining Authority issued in International Application PCT/US2010/050961 mailed Sep. 13, 2012.

* cited by examiner

ORAL CARE IMPLEMENT

CROSS-REFERENCE TO RELATED APPLICATIONS

This application is a U.S. national stage entry under 35 U.S.C. §371 of Patent Cooperation Treaty Patent Application No. PCT/US2010/050961, filed Sep. 30, 2010, the entirety of which is incorporated herein by reference.

FIELD

The present invention relates to oral care implements, and more particularly to a toothbrush with tooth cleaning elements.

BACKGROUND

Oral care implements such as toothbrushes are typically used in conjunction with a dentifrice for cleansing the teeth and/or soft tissue in the oral cavity. The dentifrice or similar oral care product may contain one or more active ingredients which when administered with a toothbrush generally via a brushing action provide an oral health benefit to the user such as removing plaque and debris from the surface of the teeth and/or gums, polishing and whitening the teeth, reducing oral surface bacteria populations, and others.

Conventional toothbrush heads generally contain a plurality of tooth cleaning elements such as bristles which temporarily support the dentifrice during its application to the teeth and/or gums. By design, such bristles usually are formed into tufts containing numerous individual bristle strands (typically made of nylon or another polymer) and are primarily adapted for removing debris. These general purpose bristles alone are not optimized for cleaning the teeth or gums or for polishing and removing stains from tooth surfaces particularly when used with a dentifrice containing whitening and polishing agents. The tips of the individual bristle strands make less than ideal surface area contact with tooth surfaces to achieve the optimum type of cleaning and polishing action desired.

Oral treatment dentifrices such as toothpaste are available in a wide variety of formulations for various purposes including tarter removal/control, whitening, reducing sensitivity, enamel protection, and others. In order for the user to obtain maximum benefit from such products, the dentifrice should preferably remain in contact with the teeth during brushing. However, the dentifrice typically migrates either into the mouth of the user from the toothbrush bristles which support the dentifrice, or is forced downwards in between and towards the base of the bristles thereby minimizing the effectiveness of the dentifrice.

A toothbrush head with tooth cleaning elements is desired which enhances cleaning/polishing effectiveness and better supports the dentifrice for application to the teeth during brushing.

SUMMARY

An oral care implement such as a toothbrush according to one embodiment of the present invention includes a head supporting a plurality of tooth cleaning elements including bristle elements and preferably one or more tooth cleaning-polishing units configured and adapted to provide enhanced cleaning, polishing, and whitening of the teeth. The cleaning-polishing units may include an elastomeric scrubbing element having a base portion and an integral tooth engaging portion comprised of a plurality of finger-like cleansing members circumferentially spaced apart on the base portion. The cleansing members may be arcuately shaped in some exemplary embodiments and project upwards from the base portion away from the toothbrush head. Preferably, the base portion has a circumferentially continuous side all to stiffen the scrubbing element. Embodiments of the oral care implement may include a circular bristle field arranged circumferentially around and associated with the scrubbing element to support the scrubbing element during brushing for preventing excessive outward splaying of the cleansing members.

In preferred embodiments, the uppermost top portion of cleansing members are terminated with a top end having a chisel-shaped or angled scrubbing surface for improving insertion depth of the cleansing member free ends between the teeth and gums and maximizing contact surface area with the teeth which beneficially results in better debris and plaque removal.

According to one embodiment of the present invention, an oral care implement includes a head defining a longitudinal axis and at least one flexible elastomeric tooth scrubbing element. The scrubbing element includes a supporting base portion attached to the toothbrush head and having a circumferentially continuous sidewall for stiffness. The scrubbing element further includes a preferably integral tooth engaging portion comprising a plurality of cleansing members circumferentially spaced apart on the base portion. The cleansing members project outwards from the base portion and collectively define a central cavity for retaining dentifrice. A top portion of the cleansing members is terminated with a top end having an angled scrubbing surface configured for engaging the teeth and gums.

According to another embodiment, an oral care implement includes a head defining a longitudinal axis and at least one flexible elastomeric tooth scrubbing element supported by the head. The scrubbing element includes a base portion attached to the toothbrush head and having a circumferentially continuous sidewall. The scrubbing element further includes a tooth engaging portion comprising a plurality of arcuate cleansing members circumferentially spaced apart on the base portion. The cleansing members project upwards from the base portion and collectively define an interior central cavity for retaining dentifrice. In some embodiments, the cleansing members further include a top portion being terminated with a top end having an angled scrubbing surface configured for engaging the teeth and gums, whereby the angled surface provides better cleaning along the tooth and gum line.

According to another embodiment, an oral care implement includes a head defining a longitudinal axis and a front brushing side and at least one cleaning-polishing unit. The cleaning-polishing unit may include a flexible elastomeric tooth scrubbing element having a cylindrical configuration. The scrubbing element includes a supporting base portion attached to the toothbrush head which preferably has a circumferentially continuous sidewall and an adjoining tooth engaging portion comprising a plurality of cleansing members circumferentially spaced apart on the base portion. The cleansing members project upwards from the base portion away from the toothbrush head and collectively define a central cavity for retaining dentifrice. A top portion of the cleansing members is terminated with a top end having an angled scrubbing surface configured for engaging the teeth and gums. The cleaning-polishing unit may further include a bristle element associated with the tooth scrubbing element that includes a plurality of bristle tufts disposed proximate to the scrubbing element which are arranged circumferentially spaced apart around the scrubbing element in a circular pattern. The circular patterned bristle tufts provide support to the cleansing members during brushing to resist excessive outward splaying of the members to enhance cleaning and polishing effectiveness.

BRIEF DESCRIPTION OF THE DRAWINGS

The features of the preferred embodiments will be described with reference to the following drawings where like elements are labeled similarly, and in which.

Figure 1:
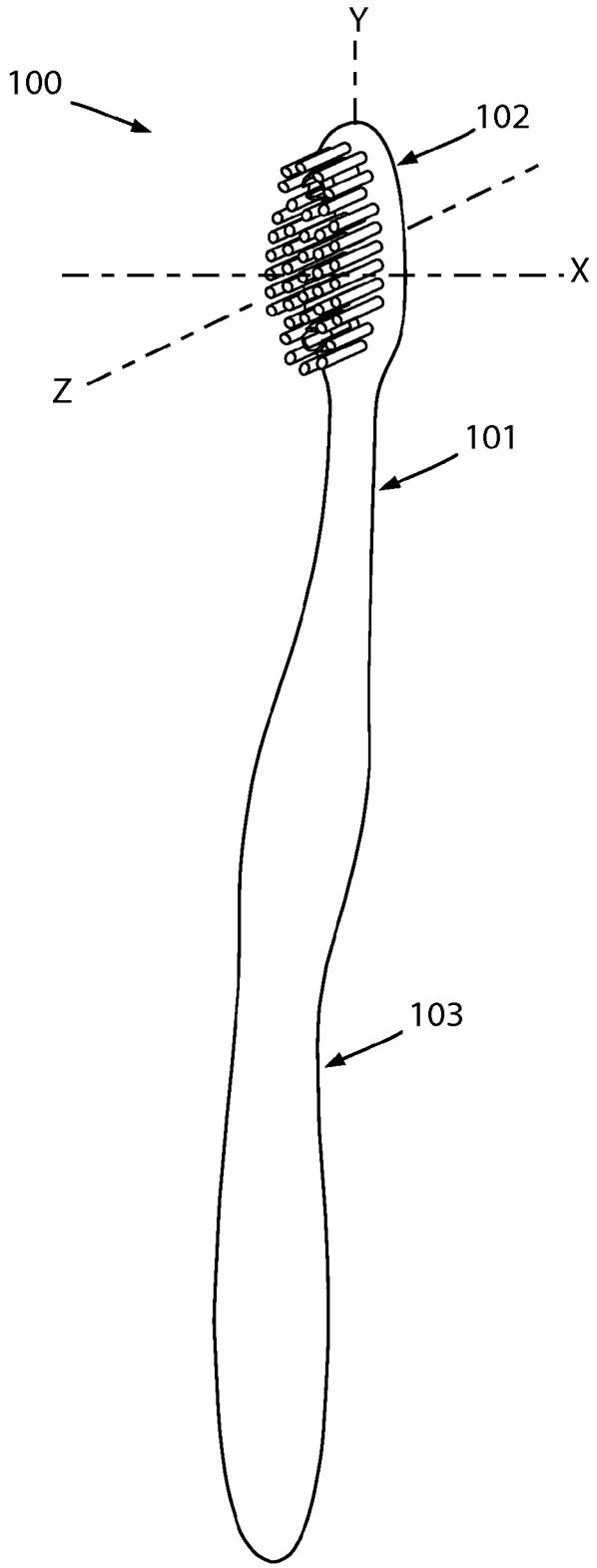
FIG. 1 is a perspective view of a toothbrush according to one exemplary embodiment of the present invention.

All drawings are schematic and not actual physical representations of the articles, components or systems described herein, and are further not drawn to scale. The drawings should be interpreted accordingly.

DETAILED DESCRIPTION

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

FIG. 1 depicts one exemplary embodiment of an oral care implement in the form of a toothbrush 100 including an elongated head 102 having a neck portion 101 and a handle 103 for grasping by a user. Handle 103 may be permanently or detachably coupled to neck portion 101; the latter detachable handle example being suitable for a toothbrush having user-replaceable heads. Handle 103 is generally elongated in shape and may have any suitable ergonomic and aesthetically pleasing configuration dimensioned to be gripped by a user. Handle 103 may be formed of one or more suitable materials conventionally used in the art for toothbrush handles including without limitation polymers, rubber, thermoplastic elastomers (TPE), and combinations thereof. Accordingly, handle 103 may be formed with many different shapes, lengths, and varieties of constructions.

In some embodiments, handle 103 may form part of a battery-operated toothbrush and include a power source and electric/electronic components. Accordingly, toothbrush head 102 is not limited in its application to either manual or battery-operated toothbrushes alone.

Referring to FIGS. 1-5, toothbrush head 102 includes a front brushing side 104, an opposing rear side 105, two opposing lateral sides 106, 107, a distal end 108, and a proximal end 109 closest to handle 103. A primary oral care region 110 is defined on front brushing side 104 between lateral sides 106 and 107, distal end 108, and proximal end 109. In some embodiments, rear side 105 may define a secondary oral care region 111 supporting an elastomeric tongue cleaner 180 with a plurality of nubs and/or other ancillary tooth or soft tissue cleaning elements. Toothbrush head 102 may have an elongated elliptical or oval shape in one possible embodiment. Neck portion 101 may be tapered and narrower in width than head 102 to smoothly transition into handle 103.

Figure 3:
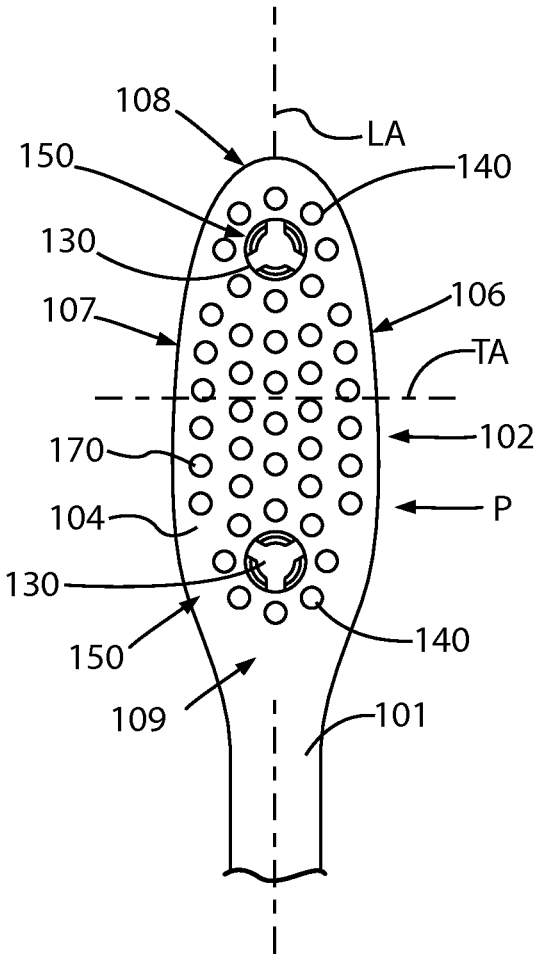
FIG. 3 is a front view of the toothbrush head of FIG. 2.

Referring to FIGS. 1 and 3, an imaginary X-Y-Z coordinate system is identified with respect to toothbrush head 102 for ease of reference in describing tooth cleaning elements 120. A horizontal plane and direction is defined by the X-Y axes (generally parallel to front brushing side 104 of toothbrush head 102) and vertical planes and directions are defined by the X-Z and Y-Z axes (generally perpendicular to front brushing side 104 of toothbrush head 102). Toothbrush head 102 has a longitudinal axis LA generally coinciding with the Y axis and a transverse axis TA perpendicular thereto coinciding with the X axis and positioned midway between distal end 108 and proximal end 109. This divides the oral care region 110 into a proximal treatment half closest handle 103 and distal treatment half closet distal end 108 of toothbrush head 102. (see FIG. 3).

Figure 4:
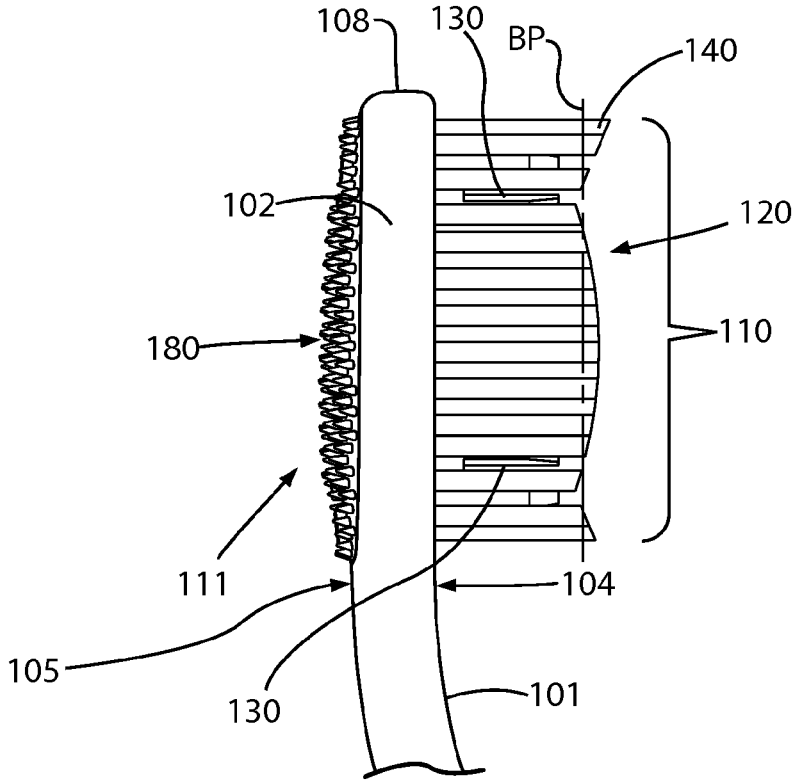
FIG. 4 is a side view of the toothbrush head of FIG. 2.
Figure 5:
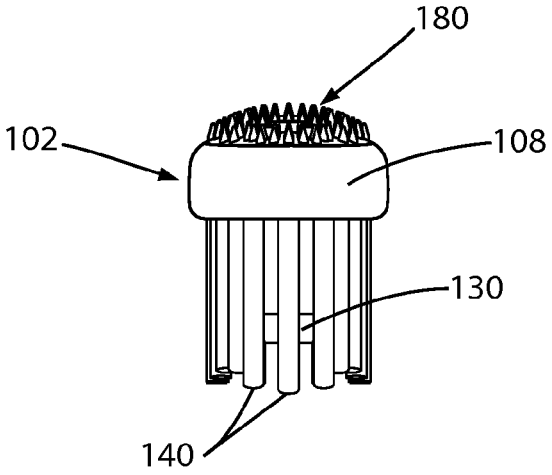
FIG. 5 is a distal end view of the toothbrush head of FIG. 2 (looking towards a handle of the toothbrush)

With continuing reference to FIGS. 1-5, front side 104 of toothbrush head 102 in oral care region 110 supports a plurality and variety of tooth cleaning elements 120 which are attached to toothbrush head 102. Tooth cleaning elements 120 may include a variety of bristle and/or elastomeric elements. As shown in FIG. 4, an imaginary nominal reference brushing plane BP is roughly defined by the tops/free ends of the tooth cleaning elements 120 which is offset from and approximately parallel to the longitudinal axis LA and front brushing side 104 of toothbrush head 102 (with variation allowing for varying heights of the cleaning elements 120 and deformation of elements 120 when pressed against the teeth). The upper portions of tooth cleaning elements 120 proximate to brushing plane BP define an active brushing zone in which the majority of contact occurs between the cleaning elements 120 and teeth during brushing occurs. The tooth cleaning elements 120 will now each he described in greater detail.

With continuing reference to FIGS. 1-5, tooth cleaning elements 120 include at least one flexible and resiliently structured tooth cleaning-polishing unit 150 as further shown in FIGS. 6-9. As further described herein, cleaning-polishing unit 150 has uniquely configured tooth contact surfaces adapted to better polish/clean the teeth and further to cradle and support the dentifrice D to minimize loss during brushing (see, e.g. FIGS. 8 and 9). In one exemplary embodiment, cleaning-polishing unit 150 may include a combination of a resilient/flexible protuberance such as elastomeric tooth scrubbing element 130 and an associated bristle element 140. In other embodiments, cleaning-polishing unit 150 may be comprised of scrubbing element 130 alone. In some exemplary embodiments, the cleaning-polishing unit 150 may he tubular or cylindrical in shape and defines a central cavity 136 for retaining, supporting and dispensing dentifrice to the oral cavity during use of toothbrush 100 as further described herein.

Figure 2:
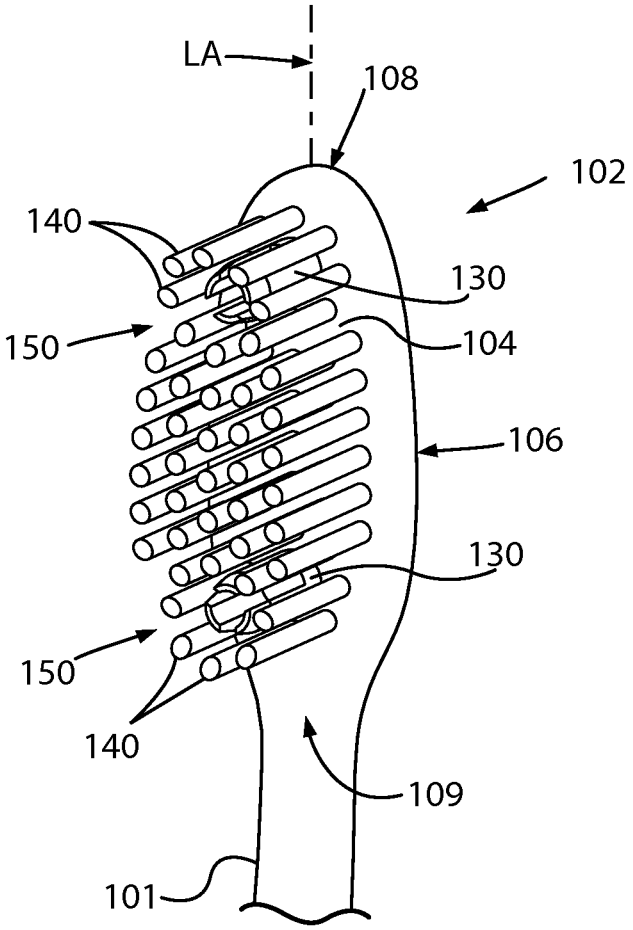
FIG. 2 is a perspective view of the toothbrush head thereof.
Figure 6:
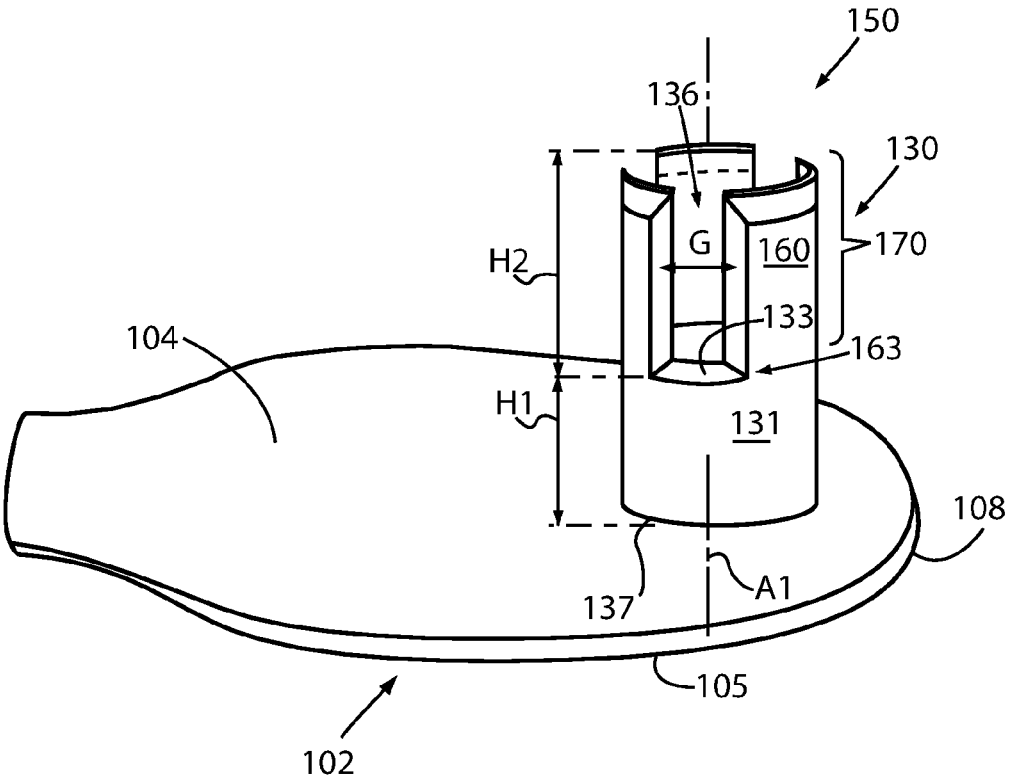
FIG. 6 is a perspective view of the toothbrush head of FIG. 2 showing only an enlarged view of one of elastomeric tooth scrubbing elements thereon.

FIG. 6 is an enlarged perspective view of toothbrush head 102 showing only one scrubbing element 130 whose size is exaggerated to be larger than in FIG. 2 to more clearly show the structure of the scrubbing element.

Figure 7:
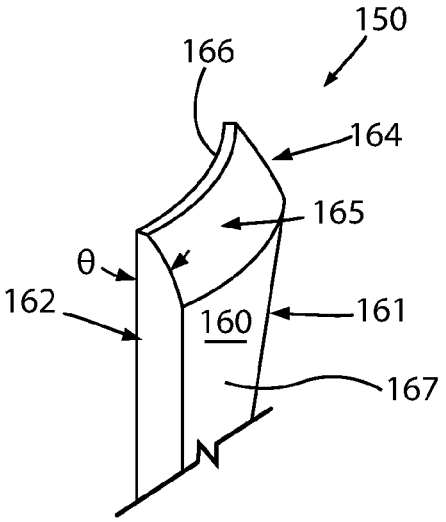
FIG. 7 is an enlarged perspective view of an upper portion of the tooth scrubbing element of FIG. 6.
Figure 8:
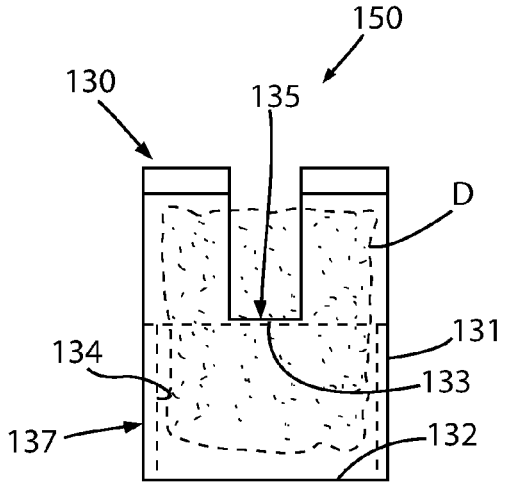
FIG. 8 is a side view of the scrubbing element of FIG. 2.
Figure 9:
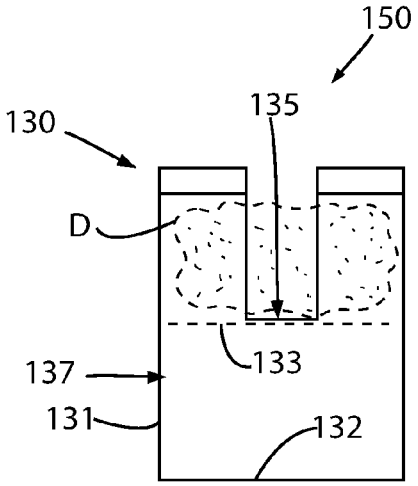
FIG. 9 is a side view of an alternative embodiment of a scrubbing element usable in the toothbrush of FIG. 1.

Referring now to FIGS. 2-10, elastomeric scrubbing element 130 includes a lower vertically elongated supporting base portion 131 extending outwards from toothbrush head 102 and an upper tooth engaging portion 170. Scrubbing element 130 defines a vertical central element axis A1 aligned concentrically with element 130 and oriented generally perpendicular to front brushing side 104 and longitudinal axis LA. Base portion 131 includes a fixed bottom end 132 secured to toothbrush head 102 and an opposite free top end 133. In one preferred embodiment, supporting base portion 131 has a generally cylindrical shape in configuration as shown and is circular in lateral cross section shape (when view from the top). Base portion 131 defines a circumferentially extending and shaped vertical sidewall 137 that extends between top and bottom ends 133, 132. In one embodiment, circumferential vertical sidewall 137 is preferably circumferentially continuous to provide rigidity to scrubbing element 130. Sidewall 137 may be straight in a vertical direction and perpendicular to front brushing surface 104 of toothbrush head 102 as best shown in FIGS. 6, 8, and 9.

In one possible embodiment shown in FIGS. 6 and 8, base portion 131 of scrubbing element 130 may be configured as a hollow tube or cylinder defining a recess 134 inside sidewall 137 which serves to hold dentifrice D and forms a part of central cavity 136. In this embodiment, top end 133 of base portion 131 therefore defines an annular top surface 135 since base portion 131 has a tubular shape with hollow center. In an alternative embodiment shown in FIG. 9, base portion 131 of scrubbing element 130 may be configured as a substantially solid cylinder or rod. In this latter embodiment, top end 133 of base portion 131 defines a generally planar solid top surface 135. The hollow tubular/cylindrical embodiment of base portion 131 shown in FIGS. 6 and 8 advantageously provides a scrubbing element 130 having additional and greater volumetric capacity for holding dentifrice D than the solid cylindrical embodiment shown in FIG. 9. In addition, the hollow cylindrical embodiment of base portion 131 shown in FIGS. 6 and 8 provides a scrubbing element 130 having greater lateral flexibility for enhancing polishing/cleaning action due to the flexible thin vertical sidewall 137 which deforms laterally more readily than the solid cylinder/rod-like base portion shown in FIG. 9. In some embodiments, however, it may be desirable to provide a more rigid solid base portion 131 as in FIG. 9 to stiffen scrubbing element 130 for harder scrubbing and removal of tough plaque deposits on the teeth. The solid cylindrical base portion 131 embodiment of FIG. 9 further reduces the chance that unused dentifrice may remain in scrubbing element 130 after brushing if toothbrush head 102 is not properly rinsed since the recess 134 of FIG. 8 is eliminated. Accordingly, it will be apparent that either of the foregoing hollow cylindrical or solid cylindrical embodiments of base portion 131 may be used depending on the intended application and desired performance characteristics of the scrubbing element 130.

In a preferred exemplary embodiment as best shown in FIG. 3, scrubbing element 130 preferably is generally cylindrical in overall shape having a circular lateral cross-sectional shape in top view. However, embodiments of scrubbing element 130 having other possible shapes are contemplated such as oval or elliptical, or various polygonal shapes including without limitation square, rectangular, triangular, hexagonal, etc. Accordingly, the invention and scrubbing element 130 is not limited to any particular cross-sectional shape.

Referring now to FIGS. 2-10, upper tooth engaging portion 170 of elastomeric scrubbing element 130 preferably includes a plurality of integrally formed and resiliently flexible finger-like cleansing members 160 protruding outwards from base portion 131 of scrubbing element 130. In one exemplary embodiment, cleansing members 160 may preferably extend outward from top surface 135 defined by top end 133 of base portion 131, and more preferably in some embodiments cleansing members 160 further extend upwards or vertically from top surface 135 in a general direction parallel to element axis A1 and perpendicular to front brushing side 104 of toothbrush head 102 as best shown in FIG. 6. Cleansing members 160 provide tooth engaging portion 170 with greater flexibility relative than stiffer base portion 131.

Referring to FIGS. 2-10, cleansing members 160 preferably may be circumferentially spaced apart on top surface 135 of base portion 131 thereby defining a generally circular pattern conforming generally to the circular lateral cross-sectional shape of the bottom portion. Preferably, cleansing members 160 are disposed along and adjacent to the lateral perimeter or edge 138 of base portion 131 (see, e.g. FIGS. 6 and 10). A plurality of corresponding gaps G are formed between adjacent cleansing members for dispensing dentifrice D laterally outwards from scrubbing element 130 to the teeth of a user. The spaced relation of cleansing members 160 also increases the flexibility of the cleansing members in contrast to stiffer base portion 131 thereby improving polishing and cleaning action on the teeth. Cleansing members 160 collectively define a portion of central cavity 136 having an upwardly open top configured for receiving and retaining the dentifrice D. In the embodiment shown in FIG. 8 described herein in which base portion 131 includes a recess 134 which communicates with cavity 136, the volumetric capacity of cavity 136 is increased for holding additional dentifrice D. It is well within the ambit of those skilled in the art to determine appropriate circumferential spacing of cleansing members 160 and width of gaps G therebetween without undue experimentation to maximize flexibility of scrubbing element 130 while minimizing excessive dentifrice D loss from cavity 136 to retain the dentifrice longer in the active brushing zone.

Figure 10:
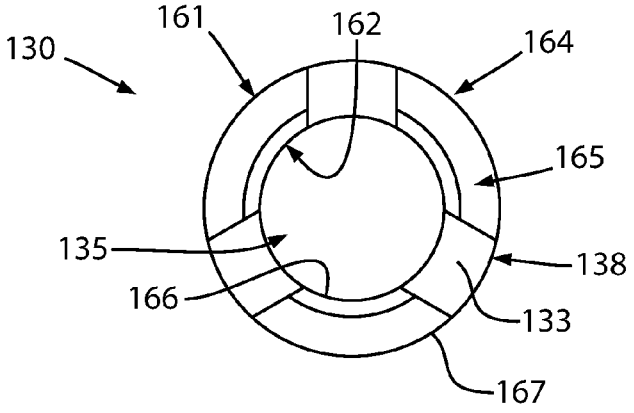
FIG. 10 is a top view of the scrubbing element of FIG. 8.

As best shown in detailed top view of FIG. 10, each cleansing member 160 preferably has a generally arcuate shape in lateral cross-sectional view (seen from the top). It will be appreciated that in embodiments where base portion 131 has a different lateral cross-sectional shape other than circular as shown herein, however, cleansing members 160 preferably have a shape that generally conforms to shape of the lateral perimeter or edge of the base portion provided so that the cleansing members may be disposed close to the edge of the base portion.

Any suitable number of cleansing members 160 may be provided. In one exemplary embodiment, three elastomeric cleansing members 160 may be provided as best shown in FIG. 3, 6, or 10. However, more or fewer cleansing member 160 may be used in other embodiments.

With continuing reference to FIGS. 2-10, each cleansing member 160 further includes a arcuately shaped vertical sidewall 167 defining an exterior facing vertical surface 161, opposing interior facing vertical surface 162, a bottom portion 163 adjacent to and integral with top surface 135 of base portion 131, and an opposite uppermost free top portion 164. In some exemplary embodiments, arcuate sidewall 167 is preferably oriented perpendicular to front brushing surface 104 of toothbrush 100 and axially aligned with circumferentially-shaped sidewall 137 of base portion 131 to complete the overall cylindrical shape of scrubbing element 130 as shown in FIGS. 6, 8, and 9.

As shown in FIGS. 6 and 7, uppermost top portion 164 of cleansing members 160 in a preferred embodiment may be terminated with chisel-shaped top end defining an angled scrubbing surface 165 for improving insertion depth of the cleansing members 160 between the teeth and gums and maximizing contact surface area between the members 160 and teeth. This unique construction results in better debris removal and cleaning than a vertically straight upper tooth/gum contact surface alone. Angled scrubbing surface 165 is preferably disposed at an angle θ that is less than 90 degrees to the interior facing vertical surface 162 of cleansing member 160 as best shown in FIG. 7. In one preferred embodiment, angled scrubbing surface 165 may be sloped inwards towards central axis A1 of scrubbing element 130 in which surface 165 is oriented to face outwards and upwards to maximize contact surface area engagement between cleansing members 160 and the teeth or gums for enhancing cleaning and polishing effectiveness. Top portion 164 in preferred exemplary embodiments defines a thin almost linear uppermost top edge 166 in the embodiment shown to better extend its reach and penetration into the space along the gum line bet the teeth and gums for better cleaning and debris removal. In some embodiments, edge 166 may be linear and configured to have a knife-like profile.

It should be noted that in addition to helping to retain dentifrice, base portion 131 of scrubbing element 130 adds stability and rigidity to the scrubbing element in contrast to cleansing member 160 which are structured to be more flexible relative to the base portion. As shown in FIG. 6, base portion 131 extends vertically or upwards from front brushing side 104 for a distance defining an axial height H1 and integral cleansing members 160 extend vertically or upwards for a distance defining an axial height H2 (H1 and H2 being measured along element axis A1 of scrubbing element 130). Heights H1 and H2 collectively define a total height Ht (i.e. Ht=H1+H2) for scrubbing element 130. The total height Ht of scrubbing elements 130 may be less than the axial height of bristles in adjacent bristle element 140 (see FIG. 4) to reduce wear on the scrubbing element ends during brushing. In some embodiments, height H1 may preferably be approximately equal to or less than height H2 to balance the desired rigidity of scrubbing element 130 while providing a suitable degree of flexibility for effective cleaning/polishing action of cleansing members 160. In exemplary embodiments, height H1 is preferably less than 50% of total height Ht, and more preferably less than 30% of total height Ht. In contrast to individual cleansing members 160 which may be each separately attached directly to toothbrush head 102, embodiments of the present invention which incorporate either an annular or solid base portion 131 to support cleansing members 160 at the attachment point to head 102 provide better resistance to splaying during brushing and concomitantly better cleaning performance.

In one preferred arrangement, at least two scrubbing elements 130 are provided as shown in FIGS. 2 and 3. As best shown in FIG. 3, scrubbing elements 130 are preferably centrally and symmetrically positioned in one embodiment between lateral sides 106, 107 and along longitudinal axis LA of the toothbrush head 102. In a preferred embodiment, two axially aligned scrubbing elements 130 may be provided with one unit being disposed between transverse axis TA and distal end 108 and another unit being disposed between transverse axis TA and proximal end 109. In other embodiments, one or both scrubbing elements 130 may be positioned off axis with respect to longitudinal axis LA. Some other embodiments may have a scrubbing element 130 positioned at the intersection of longitudinal axis LA and transverse axis TA of toothbrush head 102 at the center of the head, either in addition or instead of the distal and proximate scrubbing elements. In other embodiments scrubbing elements 130 may be positioned at other locations on head 102. Accordingly, the invention is not limited to the placement or number of scrubbing elements provided.

Elastomeric scrubbing elements 130 may be formed of any suitable flexible and resilient materials having a shape memory that are conventionally used in the art for making such elements. In some embodiments, without limitation for example, scrubbing element 136 may be made of rubber or TPE. Scrubbing element 130 may be a single unitary molded elastomeric structure in some preferred embodiments. In one possible embodiment, scrubbing elements 130 including supporting base portion 131 and cleansing members 160 may be formed as integral parts of a unitary elastomeric structure which may be molded onto toothbrush head 102 such as by injection molding in a conventional manner. In other embodiments, scrubbing elements 130 may be formed as separate structures which are secured to toothbrush head 102 by any suitable means commonly used in the art such as without limitation molding, heating, adhesives, ultrasonic or heat welding, mechanical fasteners, or in conjunction with anchor free tufting (AFT) methods. Accordingly, the invention is not limited in the method used to attach scrubbing element 130 to toothbrush head 102.

Referring now to FIGS. 1-5, some embodiments of cleaning-polishing unit 150 may further include bristle element 140 which is associated with and function in cooperation with scrubbing elements 130 to clean and polish the teeth. In some embodiments, bristle element 140 may be comprised of a plurality of individual bristle tufts extending vertically outwards from front brushing side 104 and which are circumferentially spaced around and proximate to scrubbing element 130 forming a circular bristle field pattern around each scrubbing element 130. In addition to helping improve tooth cleaning and polishing effectiveness, bristle element 140 aid in providing lateral support to scrubbing elements 130, and in particular to flexible cleansing members 160 which have a tendency to deform or splay radially outwards from element axis A1 when pressed against the teeth. Accordingly, the individual bristle tufts of bristle element 140 are preferably positioned close enough to contact and help support cleansing members 160 when deformed or splayed radially outwards during use of toothbrush 100. Preferably, bristle element 140 circumferentially encloses scrubbing elements 130 for a full 360 degrees to support cleansing members 160 regardless of which direction the cleansing members may be deformed or splayed outwards during use. The bristle tufts of bristle element 140 may have the same or differing heights (measured vertically outwards from front brushing side 104 of toothbrush head 102). In one embodiment, as best shown in FIG. 4, the bristle tufts of bristle element 140 preferably may increase in height towards the proximal and distal ends 109, 108 to increase the reach of the bristles and brushing effectiveness especially for cleaning between the cusps of the premolars and molars and/or between the interdental spaces between the teeth.

It will be appreciated that other embodiments of cleaning-polishing unit 150 may have more or less cleansing members 160 and other shaped bristles in bristle element 140. Accordingly, the invention is not limited to the exemplary embodiments shown herein. It will further be appreciated that additional bristle and/or elastomeric tooth cleaning elements such as lateral perimeter bristle elements 170 (see FIGS. 2-4) may be provided and used in conjunction with cleaning-polishing units 150 to provide a full field of tooth cleaning elements.

The tooth cleaning elements described herein may be attached to the toothbrush head by any suitable conventional method used in the art such as, without limitation for example, anchor free tufting (AFT), injection molding, ultrasonic welding, and combinations thereof. In addition, features of the exemplary embodiments described herein may be practiced and incorporated in manual or powered toothbrushes.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. An oral care implement comprising:

a head defining a longitudinal axis; and at least one flexible elastomeric tooth scrubbing element including:

a supporting base portion attached to the head, the base portion having a circumferentially continuous sidewall; and a tooth engaging portion comprising a plurality of cleansing members circumferentially spaced apart on the base portion, the cleansing members projecting outwards from the base portion and having an interior facing surface and an opposite exterior facing surface, the interior facing surfaces of the cleansing members collectively defining a central cavity, a top portion of the cleansing members comprising an angled scrubbing surface that forms a portion of the exterior facing surface of the cleansing members and an uppermost edge that extends from the interior facing surface to the exterior facing surface of the cleansing members, the uppermost edge being planar.

2. The oral care implement of claim 1, wherein the scrubbing element has an overall cylindrical shape.

3. The oral care implement of claim 1, wherein the cleansing members project vertically upwards from the base portion.

4. The oral care implement of claim 1, wherein the angled scrubbing surface is disposed at an angle of less than 90 degrees to the interior facing surface of the cleansing member.

5. The oral care implement of claim 1, wherein the base portion of the scrubbing element is configured as a hollow cylinder defining an annular top surface on which the cleansing members are arranged, the base portion further defining an interior recess therein for retaining dentifrice.

6. The oral care implement of claim 1, wherein the base portion of the scrubbing element is configured as a solid cylinder defining a flat solid circular surface on which the cleansing members are arranged.

7. The oral care implement of claim 1, further comprising a second scrubbing element, the first and second scrubbing elements being axially aligned with the longitudinal axis of the toothbrush head.

8. The oral care implement of claim 1, wherein the cleansing members have an axial height and the base portion has an axial height that is equal to or less than the height of the cleansing members.

9. The oral care implement of claim 1 wherein the exterior facing surface of each of the cleansing members comprises a first portion extending vertically from the base portion and a second portion extending from the first portion to the upper most edge of the cleansing member, the second portion forming the angled scrubbing surface and being oriented at an obtuse angle relative to the first portion.

10. An oral care implement comprising:

a head; and at least one flexible elastomeric tooth scrubbing element comprising:

a base portion attached to the head, the base portion having a circumferentially continuous sidewall; and a tooth engaging portion comprising a plurality of arcuate cleansing members circumferentially spaced apart on the base portion, the cleansing members projecting upwards from the base portion and having interior facing surfaces that collectively define an interior central cavity and opposite exterior facing surfaces, a top portion of the exterior facing surfaces of the cleansing members having an angled portion configured for engaging the teeth and gums;

wherein the angled portion of the exterior facing surface of each cleansing member extends upwardly away from the head and slopes inwardly toward a central axis of the scrubbing element at an angle that is less than 90 degrees relative to the interior facing surface of the cleansing member.

11. The oral care implement of claim 10, wherein the scrubbing element has an overall cylindrical shape.

12. The oral care implement of claim 10, wherein the base portion of the scrubbing element is configured as a hollow cylinder defining an annular top surface on which the cleansing members are arranged, the base portion further defining an interior recess therein for retaining dentifrice.

13. The oral care implement of claim 10, wherein the base portion of the scrubbing element is configured as a solid cylinder defining a flat solid circular surface on which the cleansing members are arranged.

14. The oral care implement of claim 10, further comprising a bristle element operably associated with the tooth scrubbing element and including a plurality of bristle tufts disposed proximate to the scrubbing element and circumferentially spaced apart around the scrubbing element in a circular pattern.

15. The oral care implement of claim 10 wherein the exterior facing surface of each of the cleansing members comprises a first portion extending vertically from the base portion and the angled portion extending from the first portion to an upper most edge of the cleansing member, the angled portion being oriented at an obtuse angle relative to the first portion.

16. An oral care implement comprising:

a head; and at least one cleaning-polishing unit comprising:

a flexible elastomeric tooth scrubbing element having a cylindrical configuration and including a supporting base portion attached to the head, the base portion having a circumferentially continuous sidewall, and a tooth engaging portion comprising a plurality of cleansing members circumferentially spaced apart on the base portion, the cleansing members projecting upwards from the base portion and collectively defining a central cavity for retaining dentifrice, a top portion of the cleansing members being terminated with a top end having an angled scrubbing surface configured for engaging the teeth and gums; and a bristle element operably associated with the tooth scrubbing element and including a plurality of bristle tufts disposed proximate to the tooth scrubbing element and circumferentially spaced apart around the tooth scrubbing element in a circular pattern;

wherein the angled scrubbing surfaces of each of the cleansing members lie on a surface of a cone which has a diameter that decreases with increasing distance from the head.

17. The oral care implement of claim 16, wherein each of the cleansing members comprises an interior facing surface and an opposite exterior facing surface, the interior facing surfaces collectively defining the central cavity, and wherein the angled scrubbing surface forms a portion of the exterior facing surface of the scrubbing element.

18. The oral care implement of claim 17, wherein the angled scrubbing surface is disposed at an angle of less than 90 degrees to the interior facing surface of the cleansing member.

19. The oral care implement of claim 17 wherein the exterior facing surface of each of the cleansing members comprises a first portion extending vertically from the base portion and a second portion extending from the first portion to an upper most edge of the cleansing member, the second portion forming the angled scrubbing surface and being oriented at an obtuse angle relative to the first portion.

20. The oral care implement of claim 16, wherein the base portion of the scrubbing element is configured as a hollow cylinder defining an annular top surface on which the cleansing members are arranged, the base portion further defining an interior recess therein for retaining dentifrice.

21. The oral care implement of claim 16, wherein the base portion of the scrubbing element is configured as a solid cylinder defining a flat solid circular surface on which the cleansing members are arranged.

* * * * *